US008424226B2

(12) United States Patent
Sartor et al.

(10) Patent No.: US 8,424,226 B2
(45) Date of Patent: Apr. 23, 2013

(54) SKI BOOT FOR ALPINE AND TOURING SKI

(76) Inventors: Mario Sartor, Volpago del Montello (IT); Piero Fenato, Caerano di San Marco (IT)

( * ) Notice: Subject to any disclaimer, the term of this patent is extended or adjusted under 35 U.S.C. 154(b) by 472 days.

(21) Appl. No.: 12/664,014

(22) PCT Filed: Jun. 26, 2008

(86) PCT No.: PCT/EP2008/058150

§ 371 (c)(1),
(2), (4) Date: Dec. 11, 2009

(87) PCT Pub. No.: WO2009/003904

PCT Pub. Date: Jan. 8, 2009

(65) Prior Publication Data

US 2010/0115798 A1 May 13, 2010

(30) Foreign Application Priority Data

Jul. 5, 2007 (IT) ..... VE20070024 U

(51) Int. Cl.
*A43C 13/00* (2006.01)
*A43B 5/04* (2006.01)

(52) U.S. Cl.
USPC ..... 36/117.3; 36/15

(58) Field of Classification Search ..... 36/117.1, 36/117.2, 117.3, 117.4, 117.5, 15, 100, 97; 280/614, 615, 616, 617, 618
See application file for complete search history.

(56) References Cited

U.S. PATENT DOCUMENTS

| | | | | |
|---|---|---|---|---|
| 4,351,120 | A | 9/1982 | Dalebout | |
| 4,770,441 | A * | 9/1988 | Demonsant et al. | 280/818 |
| 4,937,955 | A * | 7/1990 | Bonaventure | 36/132 |
| 5,214,865 | A * | 6/1993 | Sartor | 36/117.3 |
| 5,992,861 | A | 11/1999 | Piotrowski | |
| 6,065,228 | A | 5/2000 | Begey | |
| 6,286,855 | B1 * | 9/2001 | Paris | 280/611 |
| 6,609,313 | B2 * | 8/2003 | Orso | 36/117.3 |
| 6,685,213 | B2 * | 2/2004 | Hauglin | 280/624 |
| 6,868,624 | B1 * | 3/2005 | Trinkaus | 36/117.1 |
| 7,874,591 | B2 * | 1/2011 | Korich | 280/809 |
| 7,934,326 | B2 * | 5/2011 | Sartor | 36/117.3 |
| 2007/0204486 | A1 | 9/2007 | Fenato | |

FOREIGN PATENT DOCUMENTS

| | | |
|---|---|---|
| EP | 0199098 | 10/1986 |
| EP | 1559457 | 8/2005 |

OTHER PUBLICATIONS

International Search Report, Dec. 1, 2008.

* cited by examiner

*Primary Examiner* — Jila M Mohandesi
(74) *Attorney, Agent, or Firm* — Themis Law

(57) ABSTRACT

An improved ski boot comprising a shell (2) provided with a fastening device and internally housing an inshoe of soft material and at least two sets (5,6; 7,8) of front jaw/heel fixing unit portions removably securable to the sole (16) of the boot, characterized in that the first set (5,6) is of a form satisfying the regulations for alpine skiing and the second set (7,8) is of a form satisfying the regulations for ski mountaineering, the front jaw (7) of the second set laterally comprising holes (18) for engagement by a fork of a dynafit binding and the heel fixing unit comprising at its rear a seat (20) for engaging the heel fixing unit of the dynafit binding.

2 Claims, 4 Drawing Sheets

SKI BOOT FOR ALPINE AND TOURING SKI

The present invention relates to an improved ski boot.

Ski boots are known: they generally comprise a rigid shell of plastic material, provided with lever fastening devices and internally housing an inshoe of soft material.

The front jaw and the heel fixing unit for the sole are generally constructed in accordance with international regulations to adapt to different manufacturers' bindings. For example, in the case of boots for alpine skiing the regulations establish the characteristics of the toe and heel (dimensions, radius of curvature, degree of sole roughness, etc.) to ensure that the heel and toe are inserted perfectly into the ski binding and that, in the case of a fall with leg twisting, the boot is immediately released from the binding.

In the case of boots for ski mountaineering, the toe and heel of the boot are generally shaped differently depending on the type of binding used. In the case of the dynafit binding in which the front jaw consists of a fork and the heel fixing unit consists of two levers, both secured to the ski, the boot comprises two holes at the toe for engagement by the front jaw, the rear of the sole being provided with a notch into which the levers are inserted.

In the case of boots for ski mountaineering with a touring binding, in which the front jaw and heel fixing unit are mounted on a plate hinged to the ski, the regulations require the rear circumferential rim of the heel fixing unit to be substantially smooth.

The object of the invention is to provide an improved ski boot which can be used both for alpine skiing and for ski mountaineering, and which in the case of ski mountaineering can be used with both types of binding, i.e. dynafit and touring.

This object is attained according to the invention by an improved ski boot as described hereinafter.

Figure 1:
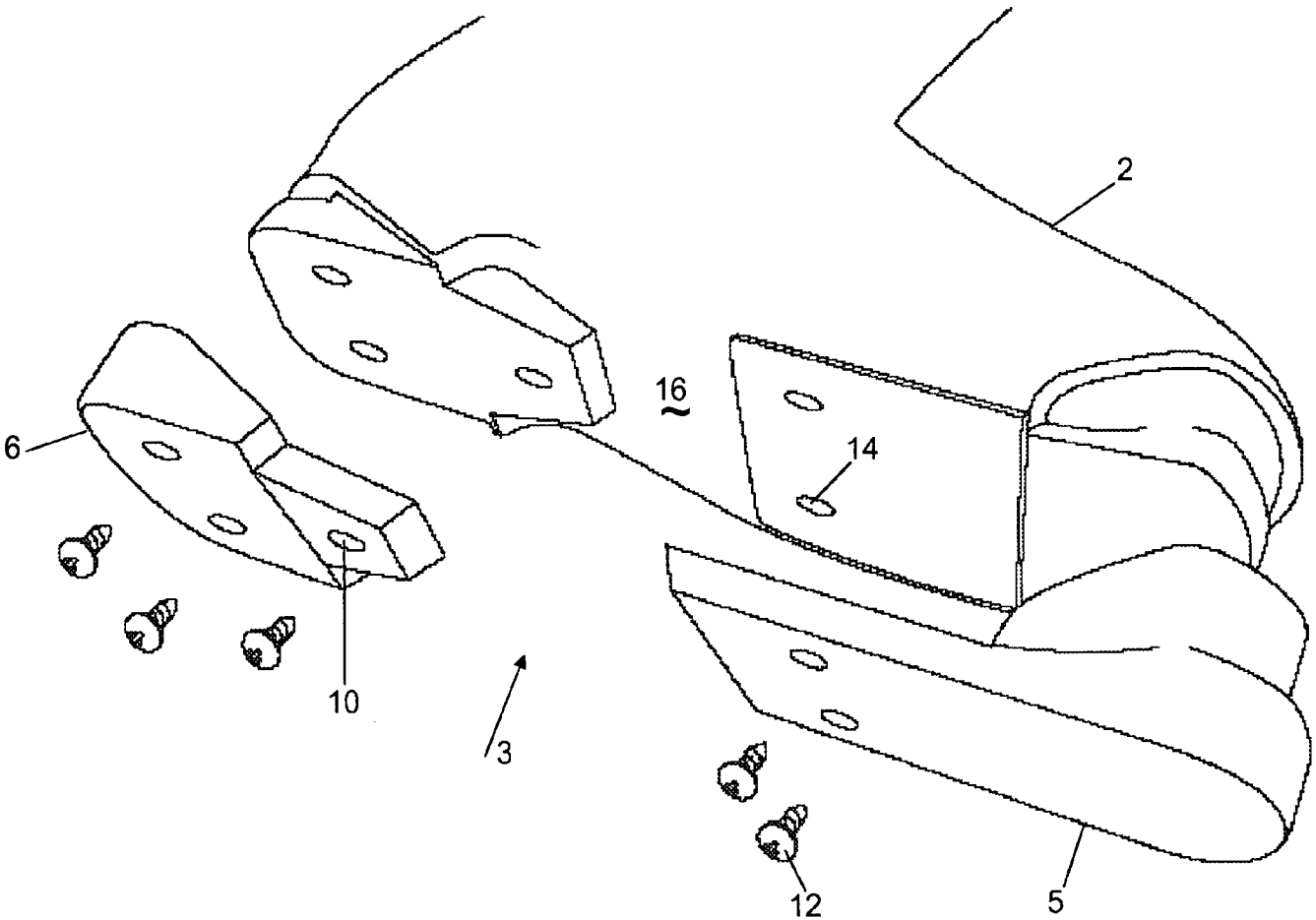
Figure 2:
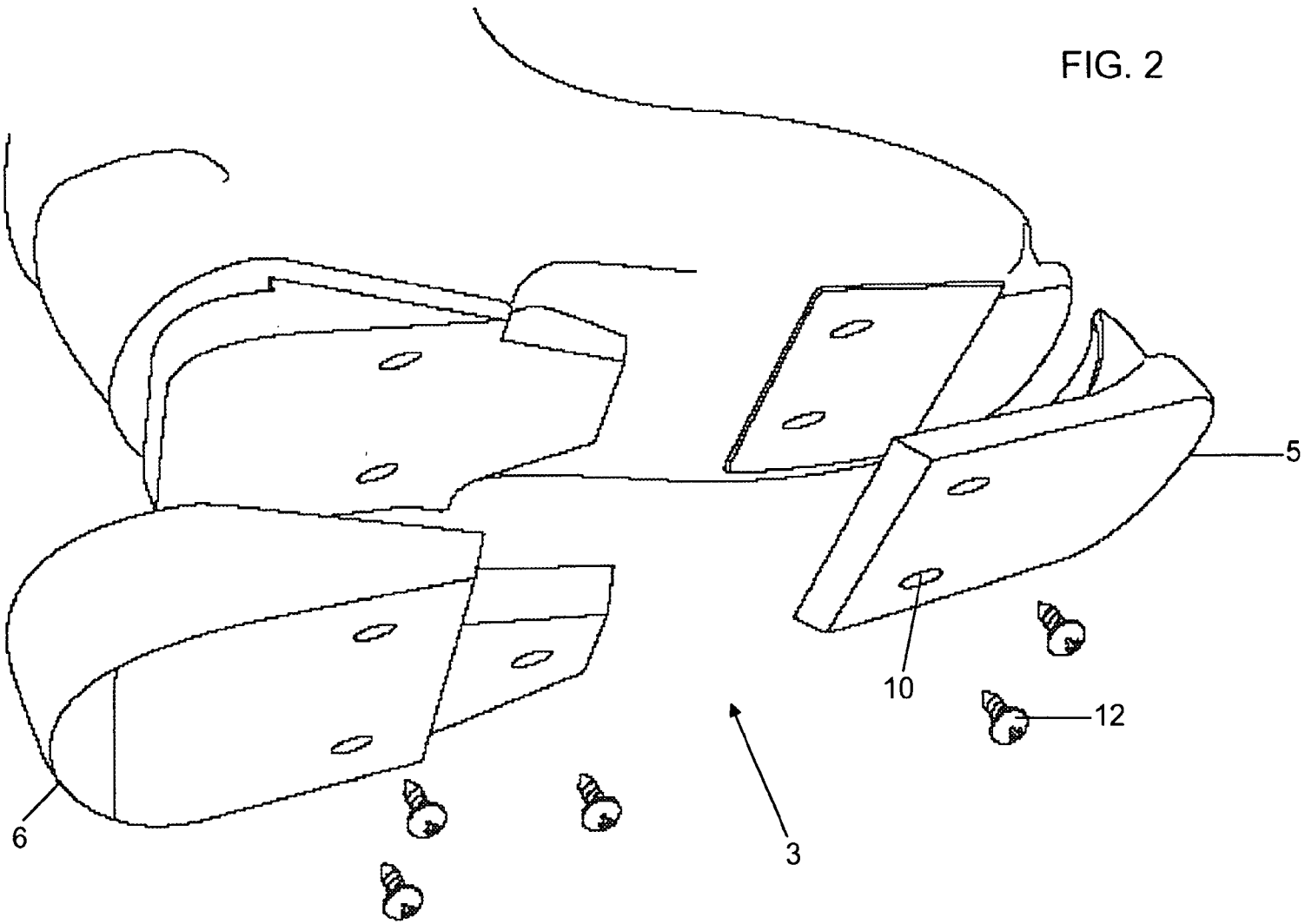
Figure 3:
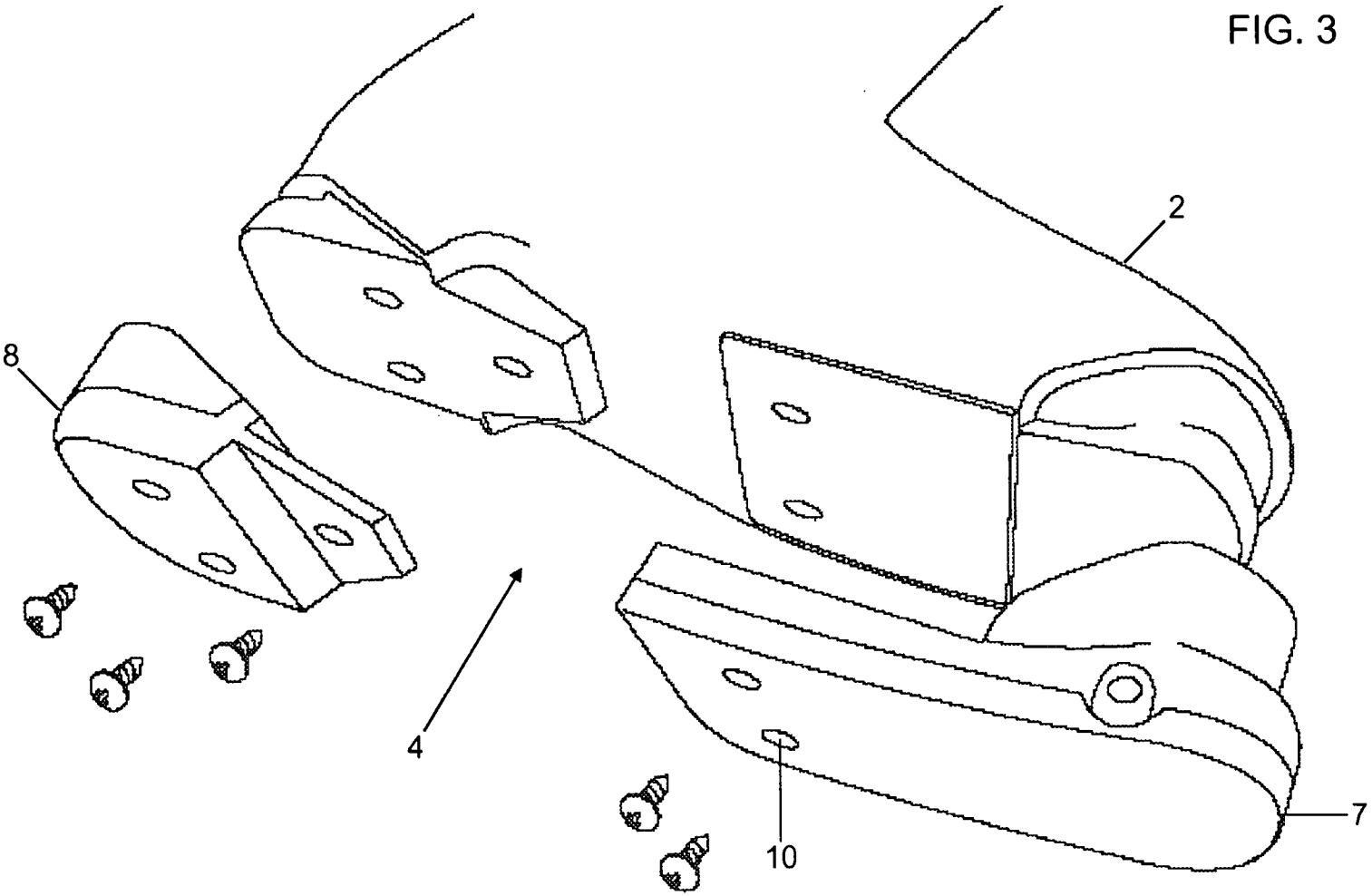
Figure 4:
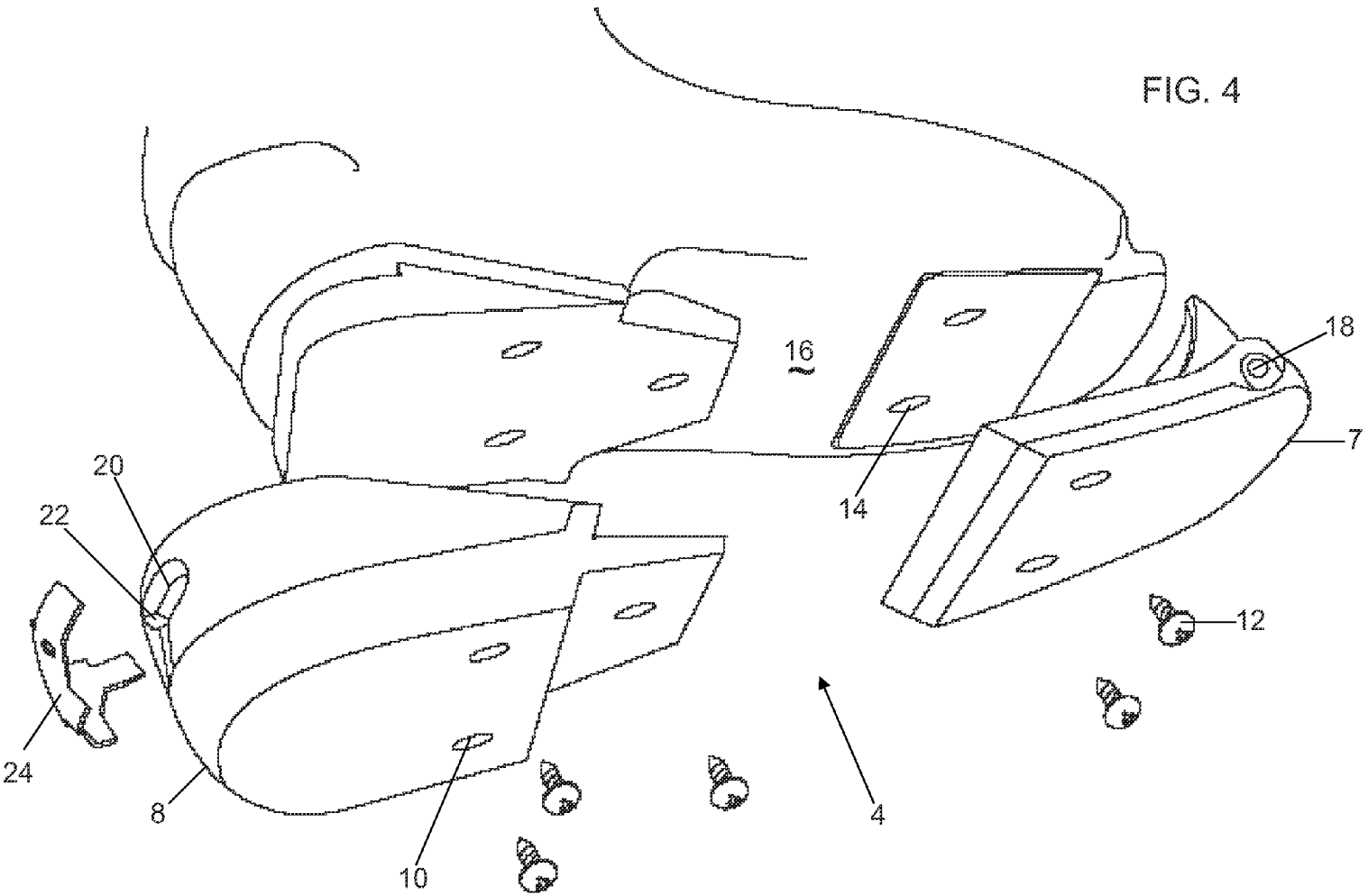

The present invention is further described hereinafter with reference to the accompanying drawings, in which:

FIG. 1 is a front perspective view of a boot in the configuration for ski mountaineering, FIG. 2 shows it in the same view as FIG. 1, in front view, FIG. 3 shows it in front perspective view in the configuration for alpine skiing, and FIG. 4 shows it in rear view.

As can be seen from the figures, the ski boot according to the invention comprises substantially a shell 2 of rigid plastic material housing internally a soft material inshoe (not shown in the drawings) and two sets 3, 4 of front jaw/heel fixing units, namely 5, 6 for alpine skiing and 7, 8 for ski mountaineering respectively.

In particular the front jaws 5, 7 and heel fixing units 6, 8 are provided with holes 10 for the application of screws 12 which likewise engage corresponding holes 14 provided in the boot sole 16.

In the embodiment shown in FIGS. 3 and 4 the front jaw 7 comprises laterally two seats 18 for engagement by the fork of a binding according to dynafit regulations, the heel fixing unit 8 presenting at its rear a seat 20 partially occupied by a metal insert 22 able to be engaged by the heel fixing unit of the regulation dynafit binding.

The invention also comprises a further insert 24 of plastic material, the shape and dimensions of which correspond exactly to those of the seat 20 so that, when the insert 22 has been removed, it can be applied to this seat in order to change the sole heel fixing unit to a substantially smooth conformation to adapt it to touring regulations.

Passage from one to the other configuration is achieved by removing the screws 12 and replacing the heel fixing unit/front jaw set by that required.

From the aforegoing it is apparent that the ski boot of the invention can be used both for alpine skiing and for ski mountaineering, and in this case with both the regulatory bindings.

The invention claimed is:

1. An improved ski boot comprising:

a shell provided with a fastening device and internally housing an insole of a soft material;

at least two sets of front jaw and heel fixing units, removably securable to a sole of the ski boot, wherein a first set of the front jaw and heel fixing units is of a form satisfying regulations for alpine skiing, and a second set of front jaw and heel fixing units is of a form satisfying regulations for ski mountaineering, the front jaw fixing unit having a front end consisting of an upright wall configured to wrap about a toe of the ski boot, the heel fixing unit having a rear end consisting of an upright wall configured to wrap about a heel of the ski boot, wherein the front jaw fixing unit of the second set laterally has openings for engagement by a fork of a dynafit binding, and wherein the heel fixing unit of the second set has, on a rear side, a seat housing a first metallic removable insert to be engaged by two levers of a heel of the dynafit binding; and a second removable insert, said second removable insert having shape and dimensions corresponding to the shape and dimensions of the seat and is applied to the seat when the first insert has been removed from the seat, such to restore a rear circumferential rim of the heel to a smooth conformation.

2. The boot as claimed in claim 1, wherein the second insert is made of a plastic material.

* * * * *